United States Patent [19]

Crona et al.

[11] Patent Number: 4,802,935

[45] Date of Patent: Feb. 7, 1989

[54] SUBSTRATE FOR A LITHOGRAPHIC PRINTING PLATE

[75] Inventors: Theodore J. Crona, New Martinsville, W. Va.; Heinz Bichsel, Heuhausen, Switzerland; Jürgen Timm, Steisslingen, Fed. Rep. of Germany

[73] Assignee: Swiss Aluminium Ltd., Chippis, Switzerland

[21] Appl. No.: 138,932

[22] Filed: Dec. 29, 1987

Related U.S. Application Data

[63] Continuation of Ser. No. 920,205, Oct. 17, 1986, abandoned.

[30] Foreign Application Priority Data

Oct. 30, 1985 [CH] Switzerland ..... 4668/85

[51] Int. Cl.[4] ..... C22C 21/00; B41N 1/08

[52] U.S. Cl. ..... 148/437; 101/459; 420/548

[58] Field of Search ..... 148/437; 420/548; 101/459

[56] References Cited

U.S. PATENT DOCUMENTS

| | | | |
|---|---|---|---|
| 4,360,461 | 11/1982 | Gray | 101/459 |
| 4,672,022 | 6/1987 | Reiss | 430/165 |

FOREIGN PATENT DOCUMENTS

| | | | |
|---|---|---|---|
| 67632 | 12/1982 | European Pat. Off. | 101/459 |
| 67056 | 12/1982 | European Pat. Off. | 101/459 |
| 29301 | 3/1977 | Japan | 101/459 |
| 63340 | 4/1985 | Japan | 101/459 |
| 63347 | 4/1985 | Japan | 101/459 |

*Primary Examiner*—Clifford D. Crowder
*Attorney, Agent, or Firm*—Bachman & LaPointe

[57] ABSTRACT

A substrate for a lithographic printing plate is made of a rolled aluminum alloy sheet of following composition: 0.8 to 2.0% Fe, up to 0.8% Si and up to 1.0% Mn, such that the sum of the Si and Mn contents lies between 0.3 and 1.3%, up to 0.3% Cu, up to 0.8% Mg, up to 2.0% Zn and 0.3% each of other constituents in total up to 1.0%, rest aluminum. A process for manufacturing such a substrate is such that this composition is cast as a 5 to 12 mm thick strip then fabricated to a 0.03 to 0.6 mm thick rolled sheet.

1 Claim, No Drawings

SUBSTRATE FOR A LITHOGRAPHIC PRINTING PLATE

This is a continuation of application Ser. No. 920,205, filed Oct. 17, 1986, now abandoned.

BACKGROUND OF THE INVENTION

The invention relates to a substrate for a lithographic printing plate made of rolled sheet of an aluminum alloy containing up to 2% iron. Also within the scope of the invention is a process for manufacturing such a substrate.

Lithographic printing plates are as a rule made up of an aluminum sheet which bears a light-sensitive layer. This sheet must satisfy a series of requirements. The printing plates, stretched over rotating cylinders must exhibit high yield strength and high fracture strength, and must not fail mechanically after a long service life of several hundred thousand passes. The mounting conditions demand high ductility. Any baking of the light-sensitive layer exposes the aluminum sheet to temperatures of 220° to 270° C.; also after such a treatment the sheet must exhibit sufficiently high static and fatigue strength values. The sheet surface is roughened mechanically, chemically or electrolytically in order to ensure adequate water flow during printing, to achieve a uniform surface of low reflectivity and also to provide a suitably adhesive base for the light-sensitive layer. This roughing must not allow pores that are too coarse to be formed as that would lead to erroneous take-up and release of printing fluid. The surface of the sheet must therefore be free of coarse precipitated intermetallic particles and also free of coarse agglomerates of fine particles as extraction of these during roughing would leave correspondingly coarse pores behind.

Conventional materials for printing sheet are the aluminum alloys AA 1050 (with 99.5% purity Al), AA 1200 (with 99.2% purity Al) and AA 3003 (containing at least 1% Mn). The alloys AA 1050 and AA 1200 do indeed exhibit a good surface finish, but have static and fatigue strength values that are too low for many printing plate applications; the alloy AA 3003 on the other hand exhibits high strength values but because of coarse precipitates and clusters of precipitates gives rise to problems when high quality finishes are required.

Alloys with higher iron contents have also been proposed, for example in patent EP-A 67 056 an aluminum alloy containing at most 1.2% Fe, the rest aluminum and impurities each at most 0.15%. In that document one is advised to avoid higher iron contents as these lead to harmful, coarse precipitates; for a further strength increase however, one is recommended to employ for the printing plate a laminate in which the mentioned alloy is to be used simply as the cover sheet along with a core material of any other aluminum alloy of higher strength. Known from the Japanese patent JP-A-52 029 301 is an aluminum alloy for lithographic printing plates, containing 0.6 to 2% Fe, at most 0.15% Si, if desired at least 0.5% Mg, the rest aluminum and trace amounts of impurities. As ingots continuously cast from melts of this composition exhibit $Al_3Fe$ particles on the surface and $Al_6Fe$ particles in the ingot interior, the $Al_3Fe$ however being in a coarser and less favourable form than the $Al_6Fe$ particles, these ingots have to be scalped deeply.

The object of the present invention is therefore to prepare a substrate for lithographic printing plates out of rolled sheet made from an aluminum alloy which satisfies the above mentioned high demands with respect to mechanical properties, surface characteristics and etching behaviour, without requiring expensive additional operations. Further, a process which leads to such a substrate should be developed.

SUMMARY OF THE INVENTION

The foregoing object is achieved by way of the invention in that the sheet has the following composition (weight %): 0.8 to 2.0% iron, up to 0.8% silicon and up to 1.0% manganese, such that the sum of the Si and Mn contents lies between 0.3 and 1.3%, up to 0.5% copper, up to 0.8% magnesium, up to 2.0% zinc and up to 0.3% each of other constituents in total up to 1.0%, the rest aluminum.

By the choice of the alloy composition, in particular the Fe, Mn and Si concentrations, high static and fatigue strength is achieved in the printing plate, also after a thermal treatment of up to 270° C. during the processing of the printing plate. The choice according to the invention also leads to a fine, uniform surface structure such as is necessary for chemical or electrolytic roughening. As a result of the alloy composition the $Al_6$ (FeMn) phase that precipitates out on casting remains stable and is not, as in order Fe-rich aluminum alloys, transformed into the undesirable $AlFe_3$ phase during subsequent heat treatments. The ternary AlFeSi phase which also appears has a fine structure. If still higher strength values are required, then Cu, Mg or Zn can be added up to the maximum levels mentioned without detracting from the excellent performance of the alloy.

It has been found advantageous to select an Fe content of 1.1 to 1.8%, a Mn content between 0.25 and 0.6%, a Si content between 0.1 and 0.4%, and a Cu content at most up to 0.3%. Particularly suitable are substrates having a weight ratio of Fe content to Mn content between 2.5 and 4.5.

With reference to the process for manufacturing a substrate using the alloy composition according to the invention that object is achieved by casting the alloy as a 5 to 12 mm thick strip and processing the same to rolled sheet of a thickness of 0.03 to 0.6 mm. The conditions prevailing during the strip casting allow the advantages of the alloy composition to be realised to the full. Particularly suitable for this purpose are casting units in which the melt is introduced into the gap between two internally cooled rolls.

A further useful process for manufacturing a substrate within the scope of the invention is to cast the alloy according to the invention in a conventional electromagnetic mold in which the metal ingot is cooled directly by a fluid without prior heat extraction through the mold. The ingot is then conventionally hot and cold rolled to a final thickness of 0.03 to 0.6 mm. The cooling conditions achieved with this casting method lead to an additional refinement of the precipitate structure both in the ingot surface and then in the sheet surface, which results in a desired improvement in etching behaviour.

Further advantages, features and details of the invention are revealed in the following description of a perferred exemplified embodiment.

DETAILED DESCRIPTION

In order to provide a comparison with conventional printing plate substrates one ingot each of the composition according to the invention (E) and of three conventional compositions (V1, V2 and V3) was continuously cast, hot rolled to 4.2 mm and then cold rolled first to 1.1 mm then to 0.25 mm (table 1). All four samples were roughened electrolytically, etched and anodized. The roughness of the substrate sheets was measured (table 4).

In addition a part of the 0.25 mm thick sheet material was subjected to an anneal of 270° C. for 3 hours. Tensile tests were performed both on the as-rolled material and on the annealed material (Table 2). In order to determine the resistance to bending, sheet samples were taken at an intermediate thickness of 1.1 mm and subjected to an alternating load of 100 MPa until fracture occurred (table 3).

The results of tensile testing show that in the as-rolled condition the substrate sheet (E) according to the invention exhibits higher strength at fracture and higher yield strength as well as higher elongation than the sheets (V1) and (V2). Only sheet (V3) exhibited higher strength at fracture and higher yield strength than (E), but at the same time much lower elongation. The sheets annealed at 270° C. for 3 hours were such that the version (E) according to the invention exhibits a different softening behaviour from that of versions (V1) and (V2): version (E) exhibits only slightly lower elongation at fracture along with higher strength and much higher yield strength values. The sheet (V3) exceeds version (E) in strength at fracture and yield strength also in the annealed condition but is much inferior with respect to elongation at fracture.

The resistance to fatigue failure, which is very important for lithographic printing plates, is demonstrated in the results of the alternating bending strength. The number of cycles to failure was 25% higher with version (E) than with version (V1).

The etchability was quantified by roughness measurements on the treated substrate material. With respect to average roughness the substrate sheet (E) according to the invention is equivalent to the conventional sheet (V1). In terms of the lateral distance between roughness peaks however, the material (E) is about 25% smaller than material (V1) which is an expression of a finer surface structure. The difference in height between the highest peak and the lowest valley is 25% greater in (V1) than in (E) which signifies a greater danger of uncontrolled retention of printing fluid in the former. Sheet material (V3) finally exhibits an approx. 50% higher average roughness; the maximum difference in height is even 125% above the corresponding parameter in (E) and 80% above that of (V1). These measurements confirm the poorer printing quality obtained in trials with the alloy AA 3003 for (V3) compared with the alloy AA 1200 for (V1) so that when high printing quality is required the alloy AA 3003 is avoided in spite of its high strength.

The substrate sheet according to the invention, however, combines high static and fatigue strength and high ductility with superior etching behaviour.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

TABLE 1

| | Alloy composition: (wt %) | | | | | | |
|---|---|---|---|---|---|---|---|
| | Si | Fe | Cu | Mn | Mg | Zn | |
| E | .12 | 1.42 | .01 | .44 | .01 | .02 | |
| V1 | .16 | .56 | .01 | .01 | .01 | .02 | AA 1200 |
| V2 | .14 | 1.05 | .01 | .01 | .01 | .04 | AA 8079 |
| V3 | .15 | .63 | .16 | 1.05 | .02 | .03 | AA 3003 |

TABLE 2

| | Results of tensile testing at 0.25 mm thickness | | | | | |
|---|---|---|---|---|---|---|
| | hard | | | after 270° C./3 h | | |
| | Rm | Rp MPa | $A_{10}$ % | Rm | Rp MPa | $A_{10}$ % |
| E | 215 | 180 | 8 | 125 | 80 | 37 |
| V1 | 170 | 158 | 7 | 85 | 35 | 40 |
| V2 | 185 | 165 | 7 | 97 | 40 | 41 |
| V3 | 290 | 275 | 4 | 165 | 130 | 22 |

Rm = Ultimate tensile strength
Rp = 0.2% proof stress
$A_{10}$ = Elongation at fracture.

Table 3

Results of the alternating bend strength test at 1.1 mm thickness in the hard, as-rolled condition. Number of cycles until failure:

| | | |
|---|---|---|
| E | 585 | 000 |
| VI | 470 | 000 |

Table 4

Roughness of the treated substrate sheet; transverse to the rolling direction:

| | $R_a$ | $R_{tm}$ (μm) | peaks/mm |
|---|---|---|---|
| E | 0.23 | 1.88 | 38 |
| V1 | 0.25 | 2.35 | 29 |
| V3 | 0.37 | 4.21 | 27 |

$R_a$ = arithmetic mean of the deviations from the middle line
$R_{tm}$ = Difference in height between the highest peak and the lowest valley.

What is claimed is:

1. An aluminum substrate for a lithographic printing plate consisting essentially of 1.1 to 1.8 wt. % iron, 0.1 to 0.4 wt. % silicon, 0.25 to 0.6 wt. % manganese, up to 0.3 wt. % copper, up to 0.8 wt. % magnesium, up to 2.0 wt. % zinc, 1.0 wt. % total of other elements which each individually do not exceed 0.3 wt. % in concentration, balance essentially aluminum wherein the sum of silicon and manganese is between 0.3 and 1.0 wt. % and said iron and manganese are present in a ratio of iron to manganese between 2.5 and 4.5, said substrate being characterized by improved mechanical properties including improved ductility and relatively high tensile and fatigue strengths, a fine substantially uniform surface structure suitable for roughening, a stable $Al_6$-(FeMn) phase that precipitates out on casting and is not transferred into an undesirable $AlFe_3$ phase during heat treatment, and a ternary AlFeSi phase which appears as a fine structure.

* * * * *